US006318099B1

(12) United States Patent
Hwang

(10) Patent No.: US 6,318,099 B1
(45) Date of Patent: Nov. 20, 2001

(54) COOLING AIR DISTRIBUTING STRUCTURE FOR REFRIGERATORS

(75) Inventor: Gui Nan Hwang, Gyeongnam (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 09/447,815

(22) Filed: Nov. 24, 1999

(30) Foreign Application Priority Data

Nov. 25, 1998 (KR) ..... 98-50744

(51) Int. Cl.[7] ..... F25D 17/04
(52) U.S. Cl. ..... 62/187; 62/408
(58) Field of Search ..... 62/187, 186, 177, 62/408

(56) References Cited

U.S. PATENT DOCUMENTS 3,455,119 * 7/1969 Bright ..... 62/180
4,704,874 * 11/1987 Thompson et al. ..... 62/187
4,852,361 * 8/1989 Oike ..... 62/131
5,201,888 * 4/1993 Beach, Jr. et al. ..... 62/187
5,487,277 * 1/1996 Bessler ..... 62/187
5,996,361 * 12/1999 Bessler et al. ..... 62/163
6,032,469 * 3/2000 Kim et al. ..... 62/89
6,125,641 * 10/2000 Kim et al. ..... 62/187

* cited by examiner

*Primary Examiner*—Harry B. Tanner
(74) *Attorney, Agent, or Firm*—Birch, Stewart, Kolasch & Birch, LLP

(57) ABSTRACT

A cooling air distributing structure for refrigerators is disclosed. The cooling air distributing structure for refrigerators has a grille panel. The grille panel defines the rear wall of the freezer compartment. The grille panel has a cooling air passageway connected to the refrigerator compartment at its lower end and is provided with a cooling air outlet for discharging a cooling air to the freezer compartment. A cooling air regulator controls a cooling air supply to the refrigerator and is mounted near to the cooling air outlet. In another embodiment, the cooling air passageway may consist of a protrusion formed by projecting a middle portion of the grille panel, and a cover plate covering the rear of the protrusion.

5 Claims, 5 Drawing Sheets

COOLING AIR DISTRIBUTING STRUCTURE FOR REFRIGERATORS

BACKGROUND OF THE INVENTION

1. Field of the Invention

The present invention relates, in general, to refrigerators and, more particularly, to a cooling air distributing structure for refrigerators.

2. Description of the Prior Art

Referring to FIGS. 1 and 2, the circulation of the cooling air of a conventional refrigerator is described hereinafter.

As shown in FIG. 1, the storage space of the refrigerator is divided into a freezer compartment 2 and a refrigerator compartment 4. The cooling air is supplied to the freezer compartment 2 and the refrigerator compartment 4 by a fan 8, the cooling air being generated by a heat exchange between air and an evaporator 7, the fan being installed in a heat exchange chamber mounted to the rear of the freezer compartment 2.

In FIG. 2, the cooling air is supplied to the freezer compartment 2 through the opening 11*a* of a shroud 11 and the air supply slot 12*a* of a grille panel 12. On the other hand, the cooling air is supplied to the refrigerator compartment 4 through the space between the shroud 11 and the grille panel 12. The grille panel 12 is provided with air return slots 12*b* at its lower portion, air circulated in the freezer compartment 2 being returned to the evaporator 7 through the air return slots 12*b*.

When the fan 8 is operated while the cooling air is generated, the cooling air is partially supplied to the freezer compartment 2 through the opening 11*a* of the shroud 11 and the air supply slot 12*a* of the grille panel 12. After the cooling air supplied to the freezer compartment 2 is circulated through the compartment 2, the cooling air is made to pass through the cooling air return slots 12*b* formed at the lower portion of the grille panel 12 and is returned to the heat exchange chamber 6 provided with the evaporator 7.

In addition, the cooling air, guided by a rib 13 between the shroud 11 and the grille panel 12, is supplied to the refrigerator compartment 4 through a refrigerator compartment duct 4*a* provided at the rear of the compartment 4. Subsequently, the supplied cooling air is circulated through the refrigerator compartment 4. The refrigerator compartment duct 4*a* is provided with a damper (not shown) at its upper portion, the damper being used to control the supply of the cooling air to the refrigerator compartment 4. When the damper is closed, the cooling air between the shroud 11, the grille panel 12 and the damper is stagnated. The cooling air circulated through the refrigerator compartment 4 is returned to the heat exchange chamber 6 through a refrigerator compartment return duct (not shown), the refrigerator compartment return duct being formed through a barrier 5.

The conventional cooling air distributing structure for refrigerators has the following defects.

According to the conventional structure, a stagnated cooling air region is generated in the middle of the cooling air passageway connected to the refrigerator compartment 4. That is, when the damper, installed in the cooling air passageway connected to the refrigerator compartment 4, shuts the cooling air passageway, the stagnated cooling air region is generated thereabout. This stagnation of the cooling air causes the following problems. Since the cooling air is partially stagnated in the passageway connected to the refrigerator compartment 4, a supply rate of the cooling air to the refrigerator compartment 4 is not capable of being exactly controlled. The generated cooling air must be distributed to the freezing compartment 2 and the refrigerator compartment 4 at a fixed distributing ratio, but the conventional structure is problematic in that the exact distributing ratio is not capable of being determined due to the existence of the stagnated cooling air region.

Additionally, since the stagnated cooling air region is generated in the lower portion of the cooling air passageway connected to the refrigerator compartment 4, the flow of the cooling air becomes deteriorated. As described above, when the cooling air is supplied to the refrigerator compartment 4 through the region between the shroud 11 and the grille panel 12, the damper is mounted to the lower end portions of the shroud 11 and the grille panel 12 so as to control the cooling air supply to the refrigerator compartment 4. As a result, when the damper is closed in order to shut the cooling air passageway connected to the refrigerator compartment 4, the cooling air is stagnated in the region of the space between the shroud 11, the grille panel 12 and the damper, thereby causing a noise due to the flow resistance generated by the stagnated cooling air region.

In order to introduce the cooling air to the refrigerator compartment 4, a certain space is prepared between the shroud 11 and the grille panel 12. Since the space between the shroud 11 and the grille panel 12 occupies the space of the refrigerator compartment 4, the space between the shroud 11 and the grille panel 12 reduces the storage space of the refrigerator compartment 4. Actually, since the space between the shroud 11 and the grille panel 12 occupies excessive space, the efficiency in utilizing space is lowered. Further, the total structure is complex due to the structures of the shroud 11 and the grille panel 12.

Since the air returned through the first air return slot 11*b* of a shroud 11 and the second return slot 12*b* of a grille panel 12 to the heat exchange chamber 6 is resisted by the shroud 11, the grille panel 12 and the stagnated cooling air region, the smooth circulation of the cooling air is hindered. That is, the path for supplying the cooling air to the refrigerator compartment is problematic in that it is complex.

According to the conventional construction illustrated in FIGS. 1 and 2, the efficiency of utilizing space is low and a flow resistance happens in the path of the cooling air.

SUMMARY OF THE INVENTION

Accordingly, the present invention has been made keeping in mind the above problems occurring in the prior art, and an object of the present invention is to provide a cooling air distributing structure for refrigerators, capable of precisely controlling the quantity of the cooling air supplied to the freezer compartment and the refrigerator compartment.

A further object of the present invention is to provide a cooling air distributing structure for refrigerators, capable of minimizing the flow noise of the cooling air by minimizing the flow resistance of the cooling air in the cooling air passageway.

A still further object of the present invention is to provide a cooling air distributing structure for refrigerators, allowing the manufacturing cost to be lowered and the assembly to be easy by simplifying the construction of the distribution structure.

Another object of the present invention is to provide a cooling air distributing structure for refrigerators, allowing the usable space of the freezing compartment to be maximized.

In order to accomplish the above object, the present invention provides a cooling air distributing structure for refrigerators, comprising a grille panel defining the rear wall of the freezer compartment, having a cooling air passageway connected to the refrigerator compartment at its lower end and being provided with a cooling air outlet discharging a cooling air to the freezer compartment, and a cooling air regulator for controlling a cooling air supply to the refrigerator, mounted near to the cooling air outlet.

In another embodiment, the cooling air passageway may consist of a protrusion formed by projecting a middle portion of the grille panel, and a cover plate covering the rear of the protrusion.

BRIEF DESCRIPTION OF THE DRAWINGS

The above and other objects, features and other advantages of the present invention will be more clearly understood from the following detailed description taken in conjunction with the accompanying drawings, in which:

FIGS. 5*a* and 5*b* are views showing the operation of a cooling air regulator, wherein FIG. 5*a* shows a completely closed state of the regulator and FIG. 5*b* shows a partially closed state of the regulator;

DESCRIPTION OF THE PREFERRED EMBODIMENTS

Referring to the accompanying drawings, the preferred embodiment will be described in the following.

Figure 1:
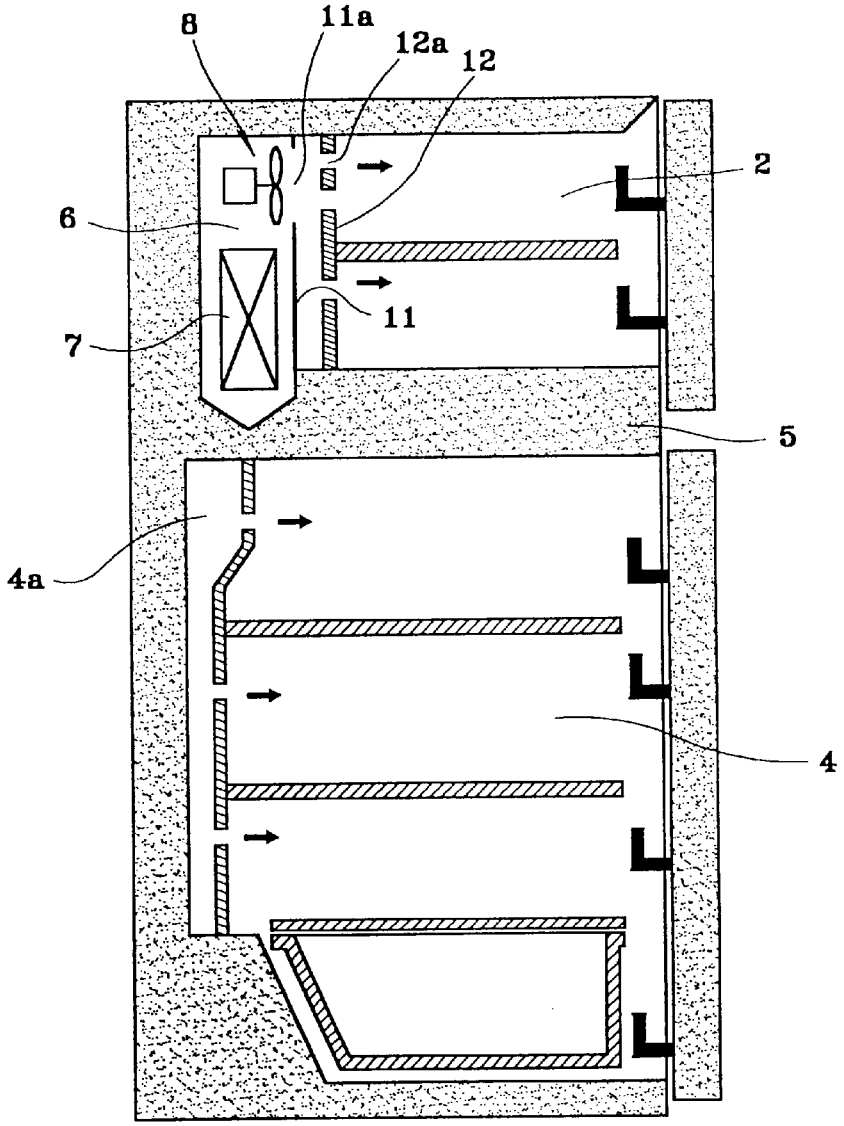
FIG. 1 PRIOR ART
FIG. 1 is a vertical sectional view showing the structure of a conventional refrigerator.
Figure 2:
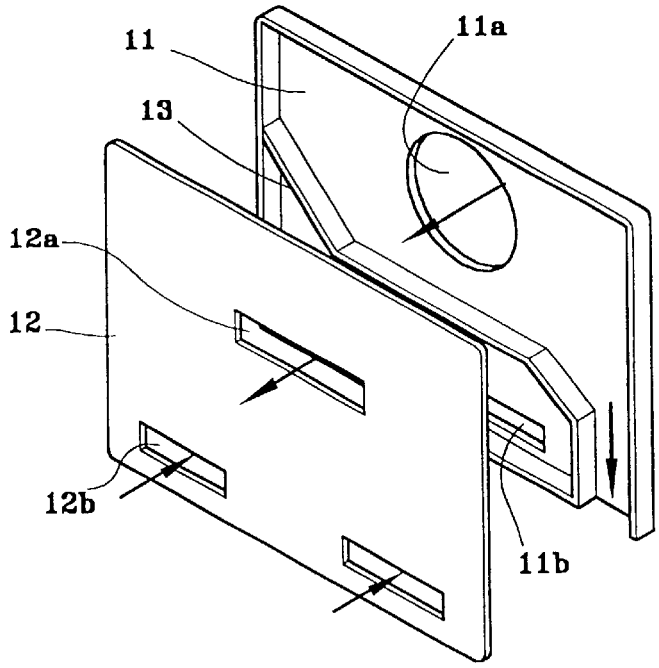
FIG.2 PRIOR ART
FIG. 2 is a perspective view showing a conventional cooling air distribution structure.
Figure 3:
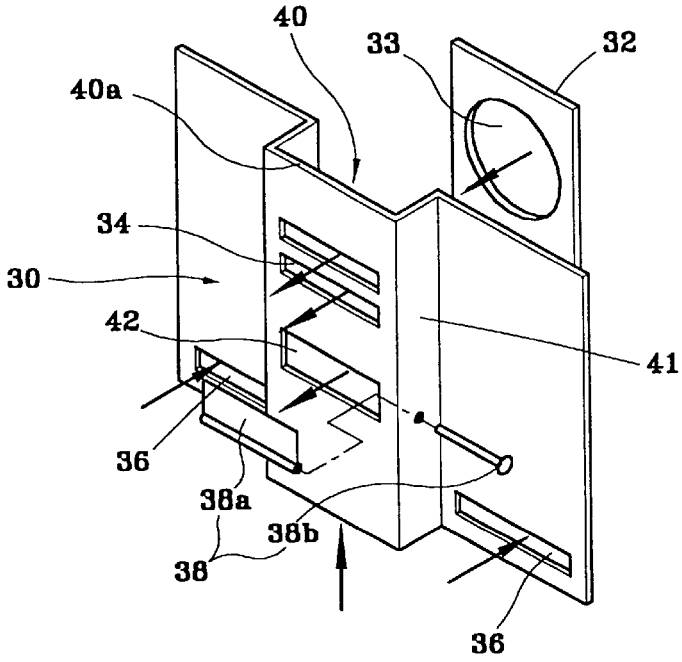
FIG. 3 is a perspective view showing a cooling air distribution structure according to an embodiment of this invention.
Figure 4:
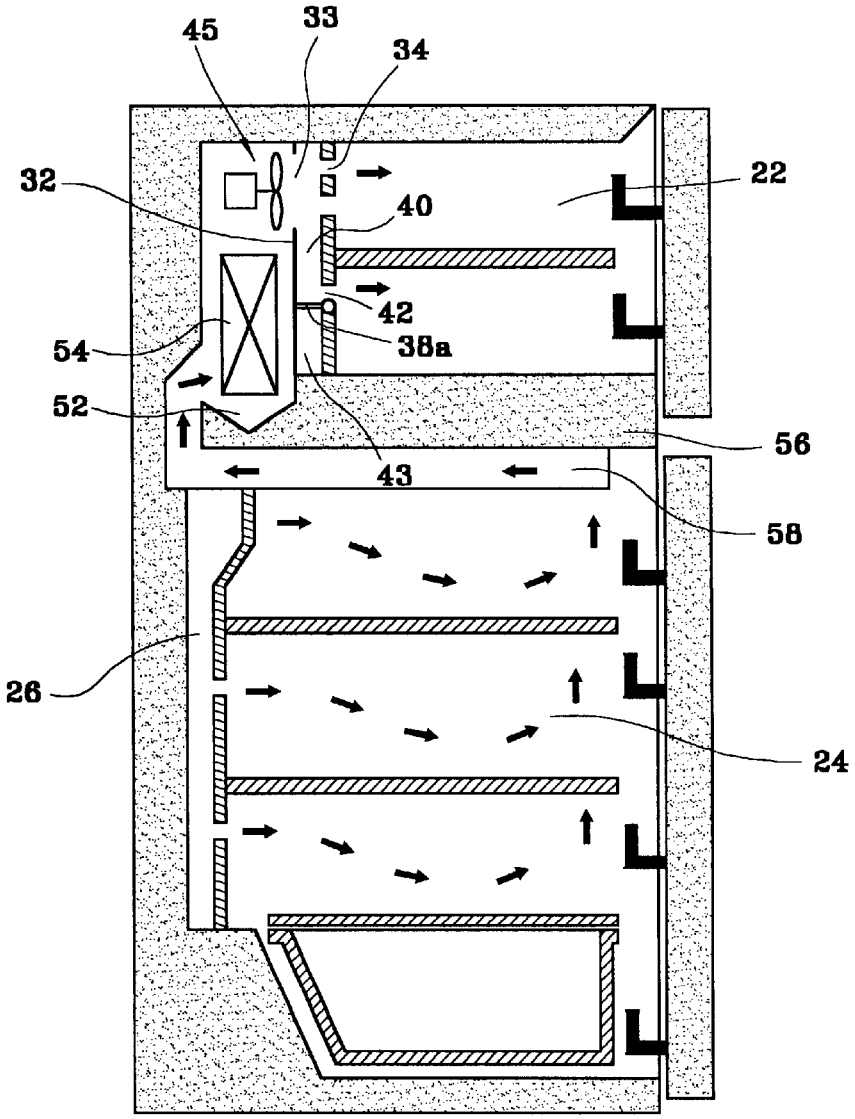
FIG. 4 is a vertical sectional view showing the structure of a refrigerator according to the embodiment.

As shown in FIGS. 3 and 4, a passageway protrusion 40*a* is formed by projecting the middle portion of the grille panel 30 forward. In the FIG. 3, the passageway protrusion 40*a* is formed by bending the grille plate four times at right angles.

A cover plate 32 is attached to the rear portion of the passageway protrusion 40*a* to form a channel together with the passageway protrusion 40*a* of the grille panel 30.

The passageway protrusion 40*a* of the grille panel 30, together with the cover plate 32, forms a cooling air passageway 40.

The grille panel 30 is provided with a plurality of upper air supply slots 34 and a middle air supply slot 42, the upper air supply slots 34 and a middle air supply slot 42 being used to supply the cooling air to a freezer compartment 22. On the other hand, the upper portion of the cover plate 32 is provided with an opening 33 through which the cooling air is supplied.

The lower end of the cooling air passageway 40 is connected to a refrigerator compartment duct 26 illustrated in FIG. 4 so as to supply the cooling air to the refrigerator compartment 24 through a barrier 56.

The cooling air passageway 40 is used to supply the cooling air to the refrigerator compartment 24 as well as the freezer compartment 22. In particular, the cooling air is supplied to the freezer compartment 22 through the upper air supply slots 34 and a middle air supply slot 42 formed in the grille panel 30, while the cooling air is supplied to the refrigerator compartment 24 through the lower end of the cooling air passageway 40 connected to the refrigerator compartment duct 26. According to this invention, the flow resistance is minimized by rendering the cooling air supply passage to be straight, thereby allow cooling air supply to be well performed.

As shown in FIG. 3, the interior of the cooling air passageway 40 is provided with a cooling air regulator 38, the regulator 38 controlling the cooling air supply to the refrigerator compartment 24. The cooling air regulator 38, as well illustrated in FIG. 6*a*, consists of a regulator plate 38*a* and a manipulating grip 38*b*. The regulator plate 38*a* is used to partially or completely close the cooling air passageway 40 connected to the refrigerator compartment 24, while the manipulating grip 38*b* is used to manipulate the regulator plate 38*a* so as to close the cooling air passageway 40 connected to the refrigerator compartment 24.

Figure 5A:
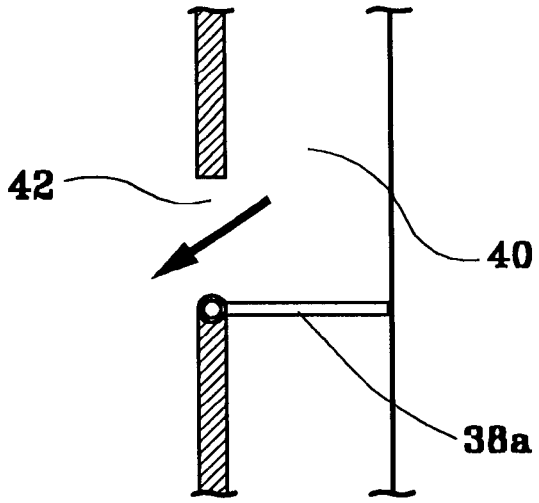
Figure 5B:
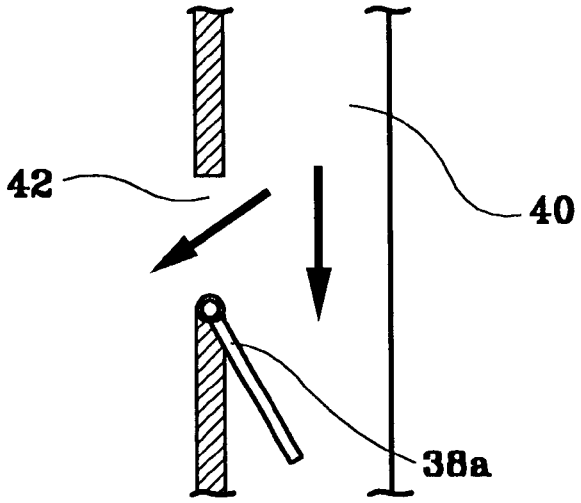

The operation of the cooling air regulator 38 for closing the cooling air passageway 40 is illustrated in FIG. 5. As shown in FIG. 5*a*, when the regulator plate 38*a* is manipulated to completely close the cooling air passageway 40, the cooling air supply is stopped. On the other hand, as shown in FIG. 5*b*, when the regulator plate 38*a* is manipulated to partially close the cooling air passageway 40, the cooling air supply is performed.

Figure 6A:
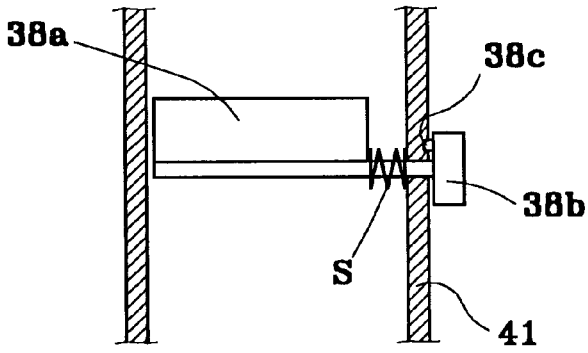
FIG. 6*a* is a partial vertical sectional view, showing the construction of the cooling air regulator.
Figure 6B:
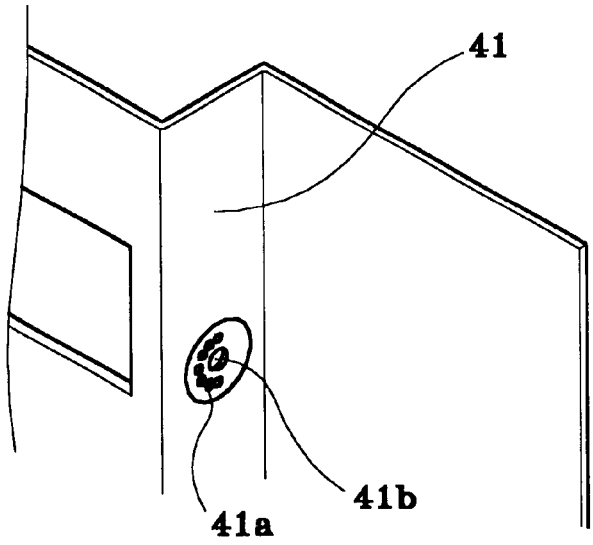
FIG. 6*b* is a perspective view showing the construction of the portion to which the regulator is mounted.

As shown in FIG. 6*a*, the inner side of the manipulating grip 38*b* is provided with a setting projection 38*c*, while the outer surface of the sidewall 41 of the passageway protrusion 40*a* is provided with a plurality of setting dents 41*a* arranged in a circle. The setting projections 8*c* are cooperated with the setting dents 41*a* so as to secure the closing position of the regulating device 38.

Incidentally, a shaft inserting hole 41*b* is formed in the center of the circle in which the dents 41*a* are arranged, the shaft for connecting the regulator plate 38*a* with the manipulating grip 38*b* being inserted through the shaft inserting hole 41*b*.

Additionally, as shown in FIG. 6*a*, in order to regulate the degree of closing the cooling air passageway 40 by manipulating the regulator plate 38*a* using the manipulating grip 38*b* and secure the position of the regulator plate 38*a*, the regulator plate 38*a* should be supported on the sidewall 41 of the cooling air passageway protrusion 40*a*. For this, a spring S is mounted between the regulator plate 38*a* and the sidewall 41.

Referring to FIG. 5*a*, the operation of the cooling air regulator 38 is described in more detail. When the cooling air passageway is required to be completely closed, the regulator plate 38*a* is positioned to be horizontal. At this time, the cooling air supply to the refrigerator compartment 24 is stopped, while the total cooling air is supplied to the freezer compartment 22 through the middle air supply slot 42. In such a case, since the cooling air regulator 38 is positioned in the vicinity of the middle air supply slot 42, a undesirable space does not exist between the regulator plate 38*a* and the middle air supply slot 42, so that the stagnated cooling air region is not generated. Consequently, there is no stagnated cooling air region in the cooling air passageway. This prevents a flow resistance and a flow noise, so that the flow efficiency of the cooling air is improved and the operating noise of the refrigerator is reduced. In addition, the cooling air distribution to the freezer compartment 22 and the refrigerator compartment 24 may be performed without the hindrance of stagnated cooling air, so that exact distribution of the cooling air to the compartments 22 and 24 is capable of being performed.

The cooling air distribution according to the cooling air distribution structure of this embodiment is described in the following.

The cooling air, generated by contacting an evaporator in a heat exchange chamber, is supplied to the cooling air passageway 40 by the fan 45. Since a shroud is not employed and the cooling air passageway 40 is formed by projecting a portion of the grille panel 30, the remaining space except a space for the passageway 40 is allowed to be used as a storage space for the freezer compartment 22. This improves the efficiency for utilizing space.

The cooling air, reaching the cooling air passageway 40, is directly supplied to the freezer compartment through the upper air supply slots 34. Otherwise, the cooling air descends in the passageway 40 and is supplied to the freezer compartment 22 through the middle air supply slot 42. When the regulator plate 38*a* is opened as shown in FIG. 5*b*, the cooling air is supplied to the refrigerator compartment 24 through the lower end of the cooling air passageway 40 and the refrigerator compartment duct 26. In such a case, the cooling air is supplied to the refrigerator compartment 24 as well as the freezer compartment 22 at the same time.

When the cooling air supply to the refrigerator compartment is not necessary, the cooling air supply is stopped by manipulation of the regulator plate 38*a* as shown in FIG. 5*a*. When the cooling air passageway 40 is closed toward the refrigerator compartment 24, the cooling air is guided to the middle air supply slot 42 by the regulator plate 38*a* and supplied to the freezer compartment 22. In this case, since the regulator plate 38*a* is situated at a position level with the lower end of the middle air supply slot 42, a space can not exist between the regulator plate 38*a* and the middle air supply slot 42, so that the stagnated cooling air region is prevented.

When the regulator slate 38*a* is closed and the compressor of the refrigerator is not operated, the cooling air does not descend toward the refrigerator compartment in the cooling air passageway. As a result, problems caused by descent of the cooling air are prevented. The problems are the formation of dew and freezing in the cooling air passageway, which are induced by the temperature difference between the cooling air in the freezer compartment and the descended cooling air.

The cooling air supplied to the refrigerator compartment 22 is circulated in the refrigerator compartment 22 and directly returned to the heat exchange chamber 52 through two air return slots 36 formed at the lower portions of the sides of the grille panel 30. In this return of cooling air through the air return slots 36, the return passage of the cooling air is simple and the flow resistance is low compared with the conventional structure because the cooling air is returned simply through the air return slots 36.

As indicated by the arrows in FIG. 4, the cooling air supplied to the refrigerator compartment 24 is circulated in the refrigerator compartment 24 and returned to the heat exchange chamber 52 through the return duct 52 provided at the lower end of the barrier 56. In such a case, the return duct 52 is possibly provided by attaching a separate injection mold duct to the lower end of the barrier 56. In addition, the return duct 52 of this invention may have the same construction as the conventional one.

The following modifications are possible within the scope of the invention.

The cooling air regulator 38*a* is described to be manipulated by hand as an example in the above, but the manipulation of the cooling air regulator 38*a* is not limited to this embodiment. As an example, the cooling air regulator 38*a* is possibly constructed to be operated automatically according to the temperature of the refrigerator compartment 24. This means that the cooling air regulator 38*a* is constructed to be operated substantially the same as the conventional damper, which controls the quantity of the supplied cooling air. That is, the conventional damper, controlling the quantity of the cooling air supplied to the refrigerator compartment 24, is mounted in the cooling air passageway 40 and, at the same time, the baffle of the damper is made to perform the function of the regulator plate 38*a*. In such a case, the baffle of the damper should be positioned just under the lower end of the middle air supply slot 42 so as to prevent the stagnated cooling air region from being generated. As described above, the conventional damper may be substituted for the cooling air regulator 38. When the conventional damper is substituted for the cooling air regulator 38 and the compressor is not operated, the formation of dew and freezing in the cooling air passageway caused by the descent of the cooling air may be prevented.

Various modifications may be possible for the return structures from the freezer compartment and the refrigerator compartment. As an example, the return duct 58 may be provided in the barrier 56 instead of being attached to the lower portion of the barrier 56.

As described above, according to the present invention, the following effects are obtained.

The stagnated cooling air region is prevented by providing a cooling air regulator just under a middle air supply slot. That is, since the stagnated cooling air region, generated when the cooling air regulator is closed, is prevented because a space does not exist between the middle air supply slot and the cooling air regulator. Additionally, according to this construction, the flow resistance, generated when the cooling air is supplied to the refrigerator compartment, is not only eliminated, but the flow noise due to the flow resistance is prevented, also. Further, when a cooling air supply is performed only to a freezer compartment, the supply is well performed because the supply is not hindered by the stagnated cooling air region.

According to this invention wherein a cooling air passageway is constructed by projecting the middle portion of a grille panel, the construction of the cooling air passageway is simple compared with a conventional one. In addition, since a complex member shroud is not necessary to be employed in this invention, the manufacturing cost of a refrigerator is lowered and the assembly of the refrigerator is simplified, thereby improving its productivity.

Incidentally, constructing a cooling air passageway by projecting the middle portion of a grille panel enlarges the usable space. Consequently, according to this invention, the usable space of a freezer compartment is maximized, thus improving the convenience of the refrigerator.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A cooling air distributing structure for refrigerators, each refrigerator consisting of a freezer compartment, a refrigerator compartment and a heat exchange chamber mounted in the rear of the freezer compartment, comprising:

a grille panel defining a rear wall of the freezer compartment, having a cooling air passageway connected to the refrigerator compartment at its lower end and being provided with a cooling air outlet for discharging a cooling air to the freezer compartment; and a cooling air regulator for controlling a cooling air supply to the refrigerator compartment, mounted near to said cooling air outlet, wherein said cooling air passageway consists of:

a protrusion formed by projecting a middle portion of said grille panel, and a cover plate covering the rear of the protrusion.

2. The structure according to claim 1, wherein said cooling air regulator consists of:

a regulator plate partially or completely closing said cooling air passageway, and means for manipulating the regulator plate so as to partially or completely close said cooling air passageway.

3. The structure according to claim 2, wherein said cooling air regulator is a grip capable of manipulating said regulator plate, the grip having a setting projection at its inner surface, the setting projection setting a closing position of the regulator plate by engaging with a dent formed on a sidewall of said cooling air passageway.

4. The structure according to claim 1, wherein said cooling air regulator is a damper having a baffle, the baffle partially or completely closing said cooling air passageway.

5. The structure according to claim 4, wherein said baffle is positioned to be even with the lower end of the said cooling air outlet when the baffle is closed, so that the cooling air is guided directly to said freezer compartment.

* * * * *